US007607763B2

(12) United States Patent
Takahashi

(10) Patent No.: US 7,607,763 B2
(45) Date of Patent: Oct. 27, 2009

(54) DROPLET DISCHARGING HEAD AND DROPLET DISCHARGING DEVICE

(75) Inventor: Hayato Takahashi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 408 days.

(21) Appl. No.: 11/686,070

(22) Filed: Mar. 14, 2007

(65) Prior Publication Data

US 2007/0222825 A1 Sep. 27, 2007

(30) Foreign Application Priority Data

Mar. 24, 2006 (JP) ..... 2006-084083

(51) Int. Cl.
*B41J 2/045* (2006.01)

(52) U.S. Cl. ..... 347/68; 347/70; 347/71

(58) Field of Classification Search ..... 347/68, 347/70–72

See application file for complete search history.

(56) References Cited

U.S. PATENT DOCUMENTS 6,918,659 B2 * 7/2005 Junhua ..... 347/71
7,362,039 B2 * 4/2008 Li ..... 310/358

FOREIGN PATENT DOCUMENTS

JP A 5-318727 12/1993
JP A-11-115181 4/1999
JP A-11-138797 5/1999
JP A 2000-79688 3/2000
JP A-2000-117968 4/2000
JP A-2001-088300 4/2001
JP A 2002-292865 10/2002
JP A 2003-326704 11/2003

* cited by examiner

*Primary Examiner*—An H Do
(74) *Attorney, Agent, or Firm*—Oliff & Berridge, PLC

(57) ABSTRACT

A droplet discharging head includes: a plurality of containing chambers provided in parallel to one another with partition walls interposed therebetween, each containing chamber, partitioned and formed by each partition wall and a member with a vibration plate, being communicated with a nozzle and containing a liquid material; a main piezoelectric element bonded onto an outer surface of the vibration plate of the containing chamber; and a sub-piezoelectric element bonded to a portion corresponding to the partition wall on a side of the main piezoelectric element of the containing chamber. The main piezoelectric element and the sub-piezoelectric element are structured so that one of the main piezoelectric element and the sub-piezoelectric element expands, when the other contracts. The vibration plate is displaced, altering a volume of the containing chamber for a droplet of the liquid material to be discharged from the nozzle. The main piezoelectric element and the sub-piezoelectric element each have a piezoelectric material layer with piezoelectricity having at least one layer, and at least one pair of electrode layers sandwiching the piezoelectric material layer. The piezoelectric material layer and the electrode layers are alternately layered in the thickness direction of the vibration plate. The piezoelectric material layer odd-numbered from a side of the containing chamber in the main piezoelectric element has an opposite polarization direction to that of the piezoelectric material layer odd-numbered from the side of the containing chamber in the sub-piezoelectric element.

9 Claims, 8 Drawing Sheets

DROPLET DISCHARGING HEAD AND DROPLET DISCHARGING DEVICE

BACKGROUND OF THE INVENTION

1. Technical Field

Several aspects of the present invention relate to a droplet discharging head and a droplet discharging device.

2. Related Art

A droplet discharging device, for example, such as an inkjet printer is provided with a droplet discharging head for discharging a droplet.

As such a droplet discharging head, for example, a head including ink chambers, which are communicated with nozzles and contain ink, and piezoelectric elements, which drives deforming wall surfaces of the ink chambers, has been known (see JP-A-5-318727, an example of related art).

In a droplet discharging head of the related art example, a part of a wall surface of an ink chamber serves as a vibration plate.

To the vibration plate is bonded the above-mentioned piezoelectric element, and around the vibration plate is bonded an auxiliary piezoelectric element.

The main piezoelectric element and the auxiliary piezoelectric element each have a piezoelectric material layer with piezoelectricity and a pair of electrode layers sandwiching the piezoelectric material layer, and expand and contract in the thickness direction of the vibration plate.

Particularly, in the related art example, the polarization direction of the piezoelectric material layer in the main piezoelectric element is the same as that of the piezoelectric material layer in the auxiliary piezoelectric element.

The main piezoelectric element and the auxiliary piezoelectric element are linked to each other on the side remote from the ink chamber.

In the foregoing droplet discharging head, part (vibration plate) of the ink chamber is displaced by expansion and contraction of the main piezoelectric element.

This causes alteration of the volume of the ink chamber, allowing ink droplets to be discharged from a nozzle.

At that point, when the main piezoelectric element expands the auxiliary piezoelectric element contracts, whereas when the main piezoelectric element contracts, the auxiliary piezoelectric element expands.

Thus, stiffness of partition walls of the ink chamber is enhanced and the driving power from the main piezoelectric element to the vibration plate is efficiently transmitted, allowing the displacement amount of the vibration plate to be increased.

As a result, electric power of the droplet discharging head can be saved.

However, in the droplet discharging head according to the related art example, since the polarization direction of the piezoelectric material layer in the main piezoelectric element is the same as that of the piezoelectric material layer in the auxiliary piezoelectric element.

This may lead to increasing the cost of the droplet discharging head in driving the main piezoelectric element and the auxiliary piezoelectric element as described above.

Specifically, wiring between the main piezoelectric element or the auxiliary piezoelectric element and a driving circuit may become complicated, and individual driving signals (voltages) for driving the main piezoelectric element and the auxiliary piezoelectric element may become required, making the driving circuit complicated.

SUMMARY

An advantage of the invention is to provide a droplet discharging head and a droplet discharging device that allow electric power saving and cost reduction.

The advantage of the invention is attained by the following aspects of the invention.

A droplet discharging head of an aspect of the invention includes: a plurality of containing chambers provided in parallel to one another with partition walls interposed therebetween, each containing chamber, partitioned and formed by each partition wall and a member with a vibration plate, being communicated with a nozzle and containing a liquid material; a main piezoelectric element bonded onto an outer surface of the vibration plate of the containing chamber; and a sub-piezoelectric element bonded to a portion corresponding to the partition wall on a side of the main piezoelectric element of the containing chamber.

In the droplet discharging head, the main piezoelectric element and the sub-piezoelectric element are structured so that one of the main piezoelectric element and the sub-piezoelectric element expands, when the other of the main piezoelectric element and the sub-piezoelectric element contracts.

When the vibration plate is displaced, a volume of the containing chamber is altered for a droplet of the liquid material to be discharged from the nozzle.

The main piezoelectric element and the sub-piezoelectric element each have a piezoelectric material layer with piezoelectricity having at least one layer, and at least one pair of electrode layers sandwiching the piezoelectric material layer.

The piezoelectric material layer and the electrode layers are alternately layered in the thickness direction of the vibration plate.

The piezoelectric material layer odd-numbered from a side of the containing chamber in the main piezoelectric element has an opposite polarization direction to that of the piezoelectric material layer odd-numbered from the side of the containing chamber in the sub-piezoelectric element.

Accordingly, electric power saving and cost reduction can be attained.

In the droplet discharging head of the aspect of the invention, it is preferable that, in each of the main piezoelectric element and the sub-piezoelectric element, the piezoelectric material layer includes a plurality of piezoelectric material layers.

This allows displacement amount of each of the main piezoelectric element and the sub-piezoelectric element to be increased, while reducing the driving voltage.

In the droplet discharging head of the aspect of the invention, it is preferable that, in each of the main piezoelectric element and the sub-piezoelectric element, two adjacent ones of the plurality of piezoelectric material layers have mutually opposite polarization directions.

This allows with more certainty displacement amount of each of the main piezoelectric element and the sub-piezoelectric element to be increased, while reducing the driving voltage.

In the droplet discharging head of the aspect of the invention, it is preferable that when an equal voltage is applied to the main piezoelectric element and the sub-piezoelectric element, the sub-piezoelectric element have a displacement amount smaller than that of the main piezoelectric element.

Accordingly, if the main piezoelectric element and the sub-piezoelectric element are driven by using an equal voltage, stable discharges can be achieved with more certainty.

In the droplet discharging head of the aspect of the invention, it is preferable that the number of the piezoelectric material layers in the sub-piezoelectric element be smaller than that in the main piezoelectric element.

Accordingly, if the main piezoelectric element and the sub-piezoelectric element are driven by using an equal voltage, stable discharges can be achieved with more certainty.

In the droplet discharging head of the aspect of the invention, it is preferable that the area of an overlapping region of the mutually adjacent electrode layers in the sub-piezoelectric element be smaller than that of an overlapping region of the mutually adjacent electrode layers in the main piezoelectric element.

Accordingly, if the main piezoelectric element and the sub-piezoelectric element are driven by using an equal voltage, stable discharges can be achieved with more certainty.

In the droplet discharging head of the aspect of the invention, it is preferable that the main piezoelectric element and the sub-piezoelectric element mutually adjacent be mutually linked on a side remote from the containing chamber.

This allows the driving force of the main piezoelectric element to be more reliably and more efficiently transmitted to a wall surface (vibration plate) of a containing chamber to increase the amount of volume variation of the containing chamber.

As a result, electric power saving and cost reduction of the droplet discharging head can be achieved with more certainty.

In the droplet discharging head of the aspect of the invention, it is preferable that the containing chamber be in a longitudinal form and the plurality of containing chambers be provided in parallel to one another in the shorter direction thereof, and the main piezoelectric element and the sub-piezoelectric element each have an odd-numbered one of the electrode layers from a side of the containing chamber, in the longitudinal direction of the containing chamber, extending part way from one end, and in order to have an overlapping region with the odd-numbered one of the electrode layers, an even-numbered one of the electrode layers from the side of the containing chamber extending part way from the other end.

This allows the main piezoelectric element and the sub-piezoelectric element to be driven by applying voltage to both ends in the longitudinal direction of each of the main piezoelectric element and the sub-piezoelectric element.

In the droplet discharging head of the aspect of the invention, it is preferable that, in the longitudinal direction of the containing chamber, the main piezoelectric element and the sub-piezoelectric element each have at one end thereof a first terminal coupled to the odd-numbered one of the electrode layers, and at another end thereof a second terminal coupled to the even-numbered one of the electrode layers.

This allows the main piezoelectric element and the sub-piezoelectric element to be driven by applying voltage between the main piezoelectric element and the sub-piezoelectric element.

In the droplet discharging head of the aspect of the invention, it is preferable that the main piezoelectric element and the sub-piezoelectric element that are mutually adjacent are mutually linked with a substrate provided therebetween on a side remote from the containing chamber, and the first terminal and the second terminal be bent in an L shape from each of the main piezoelectric element and the sub-piezoelectric element to the substrate.

This allows the driving force of the main piezoelectric element to be more reliably and more efficiently transmitted to a wall surface (vibration plate) of the containing chamber to increase the amount of volume variation of the containing chamber, and voltage to be applied to the first and second terminals on the substrate.

A droplet discharging device of another aspect of the invention includes the droplet discharging head of the aspect of the invention.

Accordingly, it is possible to provide a droplet discharging device that has low-cost and stable discharge performance.

In the droplet discharging device of another aspect of the invention, it is preferable that the droplet discharging device further include a drive unit for driving each of the main piezoelectric element and the sub-piezoelectric element, and the drive unit be coupled to each of the main piezoelectric element and the sub-piezoelectric element so as to simultaneously apply an voltage with an identical waveform to each of the main piezoelectric element and the sub-piezoelectric element.

Accordingly, it is possible to achieve stable discharges and, at the same time, to reduce the cost of a droplet discharging device with more certainty.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of a droplet discharging head and a droplet discharging device of the invention will be described below.

Prior to the description on a droplet discharging head of an embodiment of the invention, a droplet discharging device including the droplet discharging head of an embodiment of the invention, that is, a droplet discharging device of an embodiment of the invention will now be described.

Droplet Discharging Device

Figure 1:
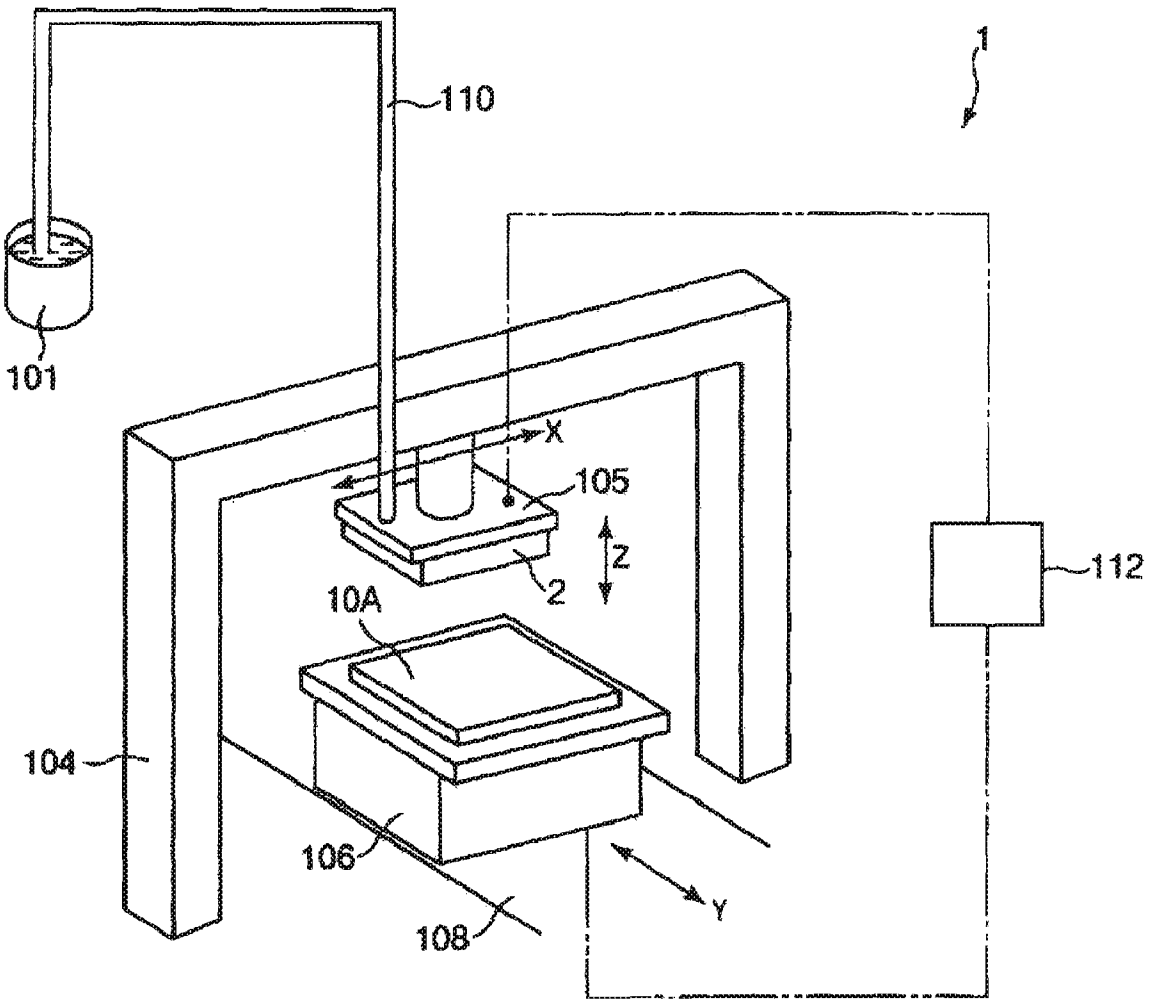
FIG. 1 is a view showing the schematic structure of a droplet discharging device according to a first embodiment of the invention.
Figure 2:
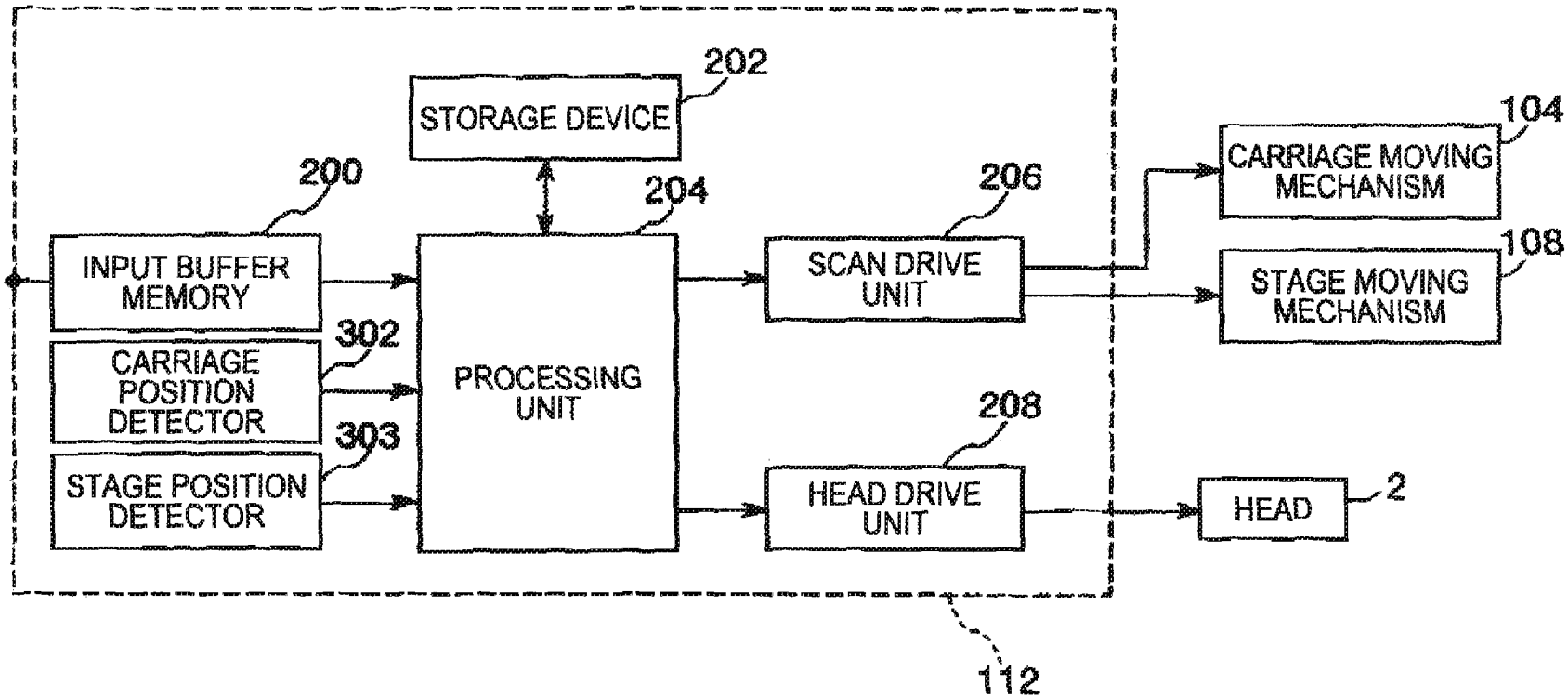
FIG. 2 is a block diagram showing the structure of a control system of the droplet discharging device shown in FIG. 1.

FIG. 1 is a view showing the schematic structure of a droplet discharging device according to a first embodiment of the invention, and FIG. 2 is a block diagram showing the structure of a control system of the droplet discharging device shown in FIG. 1.

As shown in FIG. 1, a droplet discharging device 1 includes a carriage 105 on which a plurality of droplet discharging heads 2 for discharging droplets are mounted, a carriage moving mechanism (moving unit) 104 that moves the carriage 105 in a horizontal direction (hereinafter referred to as an "X-axis direction"), a stage 106 that holds a substrate 10, onto which droplets are to be given, a stage moving mechanism (moving unit) 108 that moves the stage 106 in a horizontal direction perpendicular to the X-axis direction (hereinafter referred to as a "Y-axis direction"), and a controller 112.

Placed in the vicinity of the droplet discharging device 1 are tanks 101 that store a liquid material 111. The tanks 101 and the carriage 105 are coupled with each other through a tube 110 serving as a channel along which the liquid material 111 is transferred. The liquid material 111 stored in each tank 101 is transferred (supplied) to each droplet discharging head 2 by, for example, the force of compressed air.

The liquid material 111 is not particularly limited as far as it has a viscosity that can be discharged from the droplet discharging head 2, and various types of liquid materials, solutions and dissolving liquids may be used as the liquid material 111.

The liquid material 111 may have a solid material dispersed therein as far as the material is a fluid on the whole.

In other words, the liquid material 111 is made of a constituent material of a color element film dissolved or dispersed in a solvent, and may be in solution form or may be in dispersion form (suspension or emulsion).

Operations of the carriage moving mechanism 104 are controlled by the controller 112.

The carriage moving mechanism 104 of the present embodiment has a function of moving the carriage 105 along a Z-axis direction(vertical direction) and adjusting the height.

The carriage moving mechanism 104 also has a function of rotating the carriage 105 around an axis parallel to the Z-axis, thereby permitting fine adjustment of the angle around the Z-axis of the carriage 105.

The stage 106 has a plane parallel to both the X-axis direction and the Y-axis direction.

The stage 106 is designed such that the substrate 10, onto which droplets are to be given, can be fixed to or held on the plane.

The stage moving mechanism 108 moves the stage 106 along the Y-axis direction orthogonal to both the X-axis direction and the Y-axis direction.

Operations of the mechanism is controlled by the controller 112.

Further, the stage moving mechanism 108 of the embodiment also has a function of rotating the stage 106 around an axis in parallel to the Z-axis, thereby permitting fine adjustment of the slope around the Z-axis of the substrate 10 mounted on the stage 106 to correct the substrate to be straight.

As described above, the carriage 105 is moved in the X-axis direction by the carriage moving mechanism 104.

The stage 106, in contrast, is moved in the Y-axis direction by the stage moving mechanism 108.

That is, the relative position of the carriage 105 to the stage 106 is changed by the carriage moving mechanism 104 and the stage moving mechanism 108.

As shown in FIG. 2, the controller 112 includes an input buffer memory 200, a storage device 202, a processing unit 204, a scan drive unit 206, a head drive unit 208, a carriage position detector 302 and a stage position detector 303.

The input buffer memory 200 and the processing unit 204 are coupled with each other to be mutually communicatable.

The processing unit 204 and the storage device 202 are coupled with each other to be mutually communicatable.

The processing unit 204 and the scan drive unit 206 are coupled with each other to be mutually communicatable.

The processing unit 204 and the head drive unit 208 are coupled with each other to be mutually communicatable.

Further, the scan drive unit 206 is coupled with the carriage moving mechanism 104 and the stage moving mechanism 108 to be mutually communicatable.

Likewise, the head drive unit 208 is coupled with each of the plurality of droplet discharging heads 2 to be mutually communicatable.

The input buffer memory 200 receives data regarding the position for discharging droplets of the liquid material 111, namely, drawing pattern data from an unshown external information processor.

The input buffer memory 200 supplies the drawing pattern data to the processing unit 204, and the processing unit 204 stores the drawing pattern data in the storage device 202.

The storage device 202 is constituted of a random access memory (RAM), a magnetic recording medium, a magnet-optic recording medium or the like.

The carriage position detector 302 detects the position (moving distance) in the X-axis direction of the carriage 105, that is, the droplet discharging head 2, and inputs the detection signal to the processing unit 204.

The stage position detector 303 detects the position (moving distance) in the Y-axis direction of the stage 106, that is, a main body 10A, and inputs the detection signal to the processing unit 204.

The carriage position detector 302 and the stage position detector 303 are constituted of, for example, a linear encoder, a laser scale or the like.

The processing unit 204 controls (closed loop control) operations of the carriage moving mechanism 104 and the stage moving mechanism 108 through the scan drive unit 206 on the basis of the detection signal of the carriage position detector 302 and the stage position detector 303, controlling the position of the carriage 105 and the position of the substrate 10.

The processing unit 204 also controls the movement speed of the stage 106, that is, the substrate 10 by controlling operations of the stage moving mechanism 108.

Further, the processing unit 204 provides a selection signal of specifying the on/off state of a nozzle 32 at each discharge timing to the head drive unit 208 on the basis of the above-mentioned drawing pattern data.

On the basis of the selection signal, the head drive unit 208 provides to the droplet discharging head 2 a discharge signal required for discharge of the liquid material 111. As a result, the liquid material 111 is discharged as droplets from the corresponding nozzle 32 in the droplet discharging head 2.

The controller 112 is a computer including, for example, a central processing unit (CPU), a read only memory (ROM) and a RAM.

In this case, the above-described functions of the controller 112 are implemented by software programs that are executed by the computer.

The controller 112 may be, of course, a dedicated circuit (hardware).

Here, the droplet discharging head 2 will be described in detail as one example of a droplet discharging head of an embodiment of the invention, referring to FIGS. 3 to 5, FIGS. 6A and 6B, and FIGS. 7A to 7C.

Figure 3:
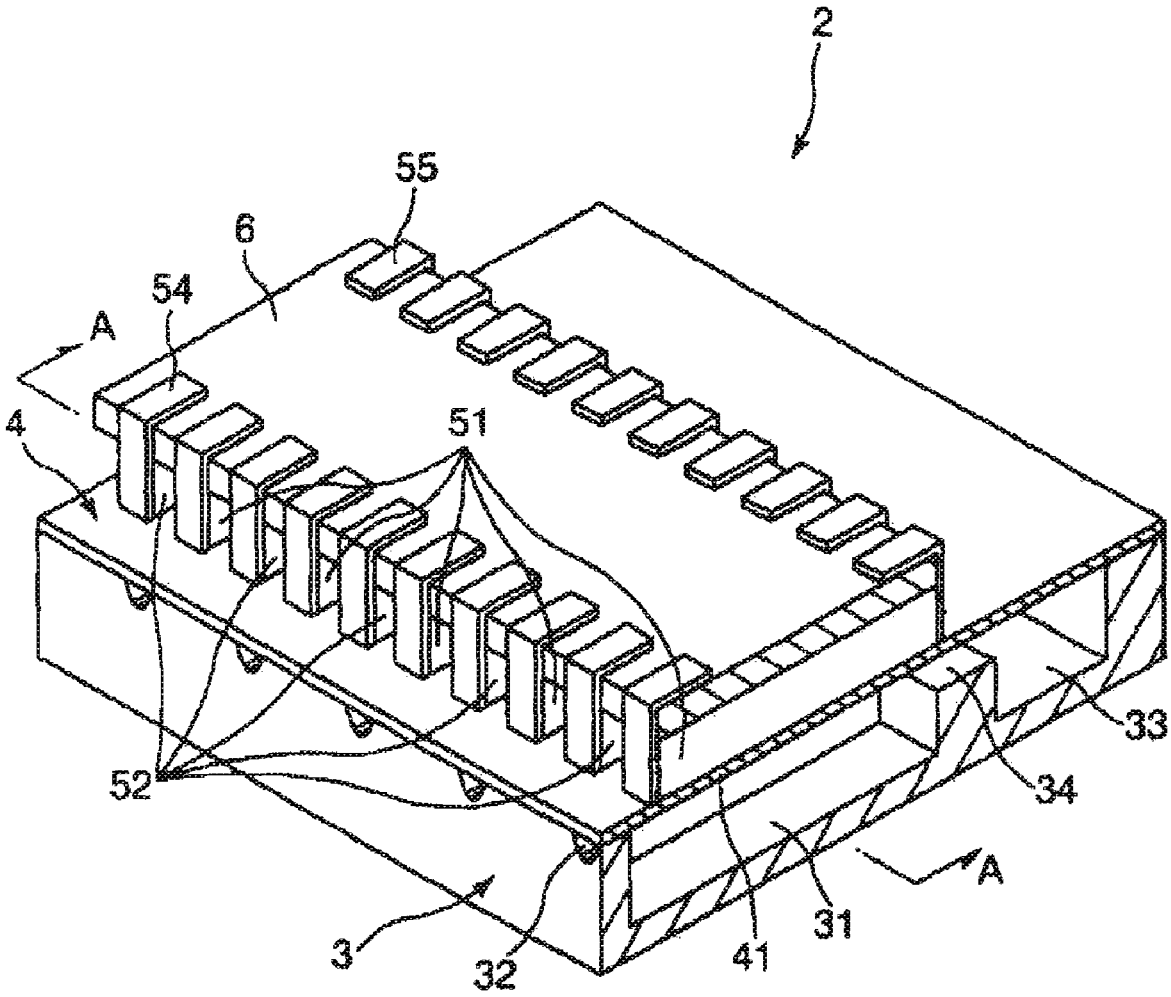
FIG. 3 is a perspective view showing the schematic structure of part of a droplet discharging head provided in the droplet discharging device shown in FIG. 1.

FIG. 3 is a perspective view showing the schematic structure of a droplet discharging head provided in the droplet discharging device shown in FIG. 1.

Figure 4:
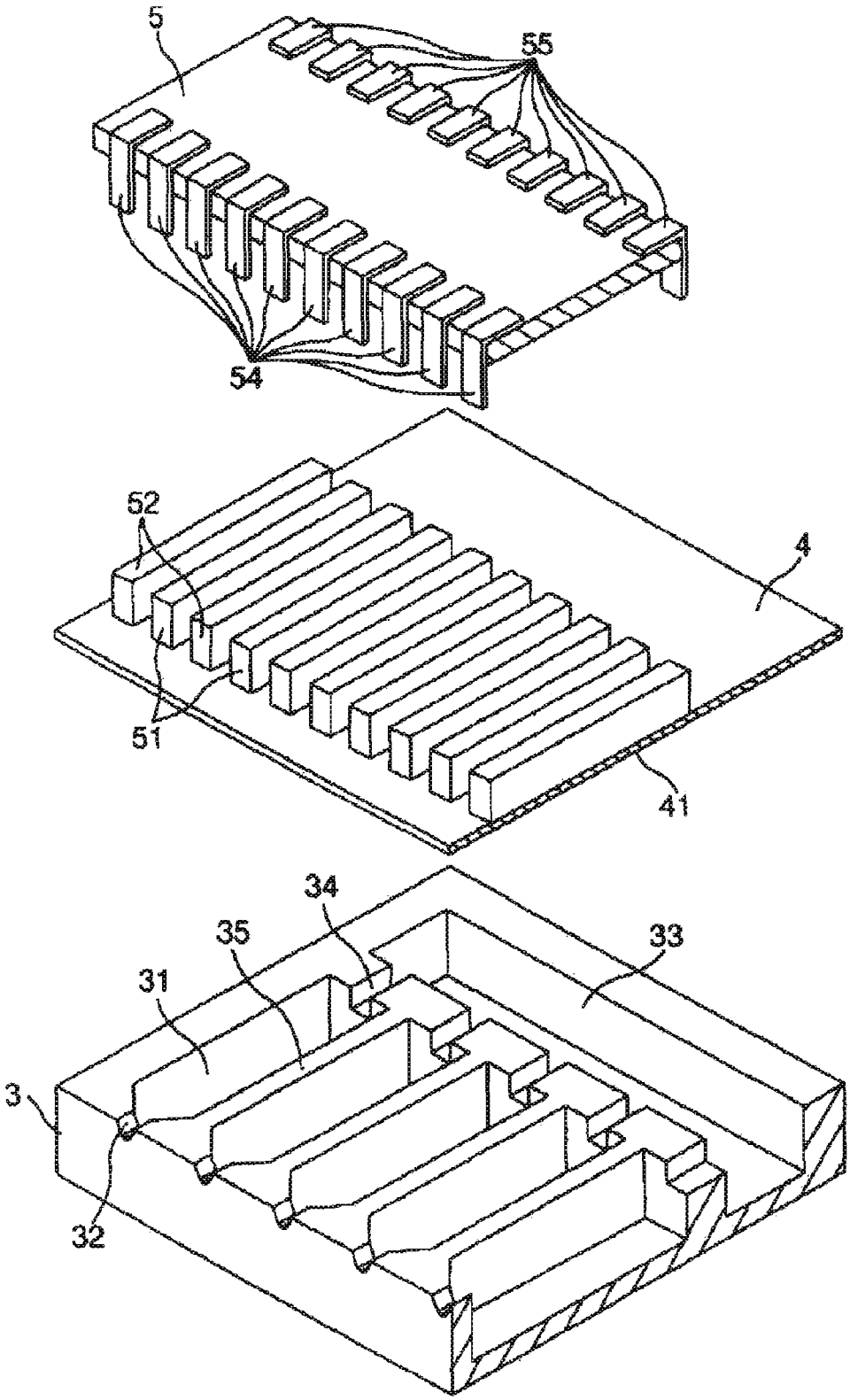
FIG. 4 is an exploded perspective view of the droplet discharging head shown in FIG. 3.

FIG. 4 is an exploded perspective view of the droplet discharging head shown in FIG. 3.

Figure 5:
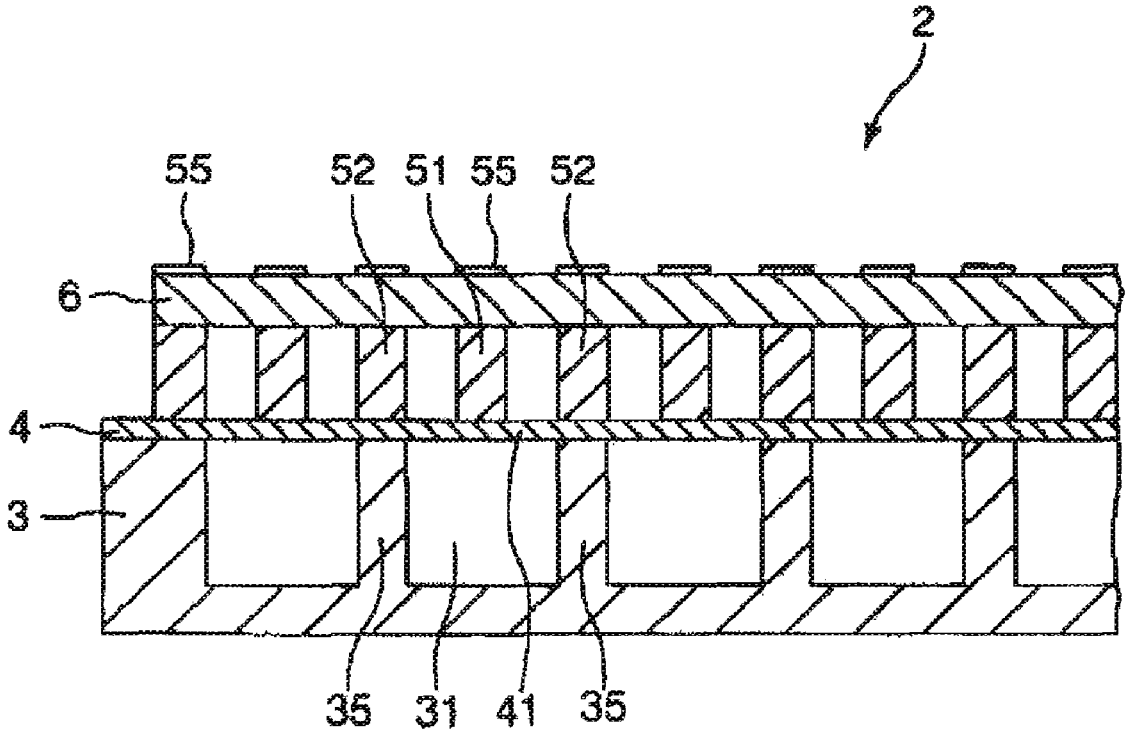
FIG. 5 is a sectional view taken along the line A-A in FIG. 3.

FIG. 5 is a sectional view taken along the line A-A in FIG. 3.

Figure 6A:
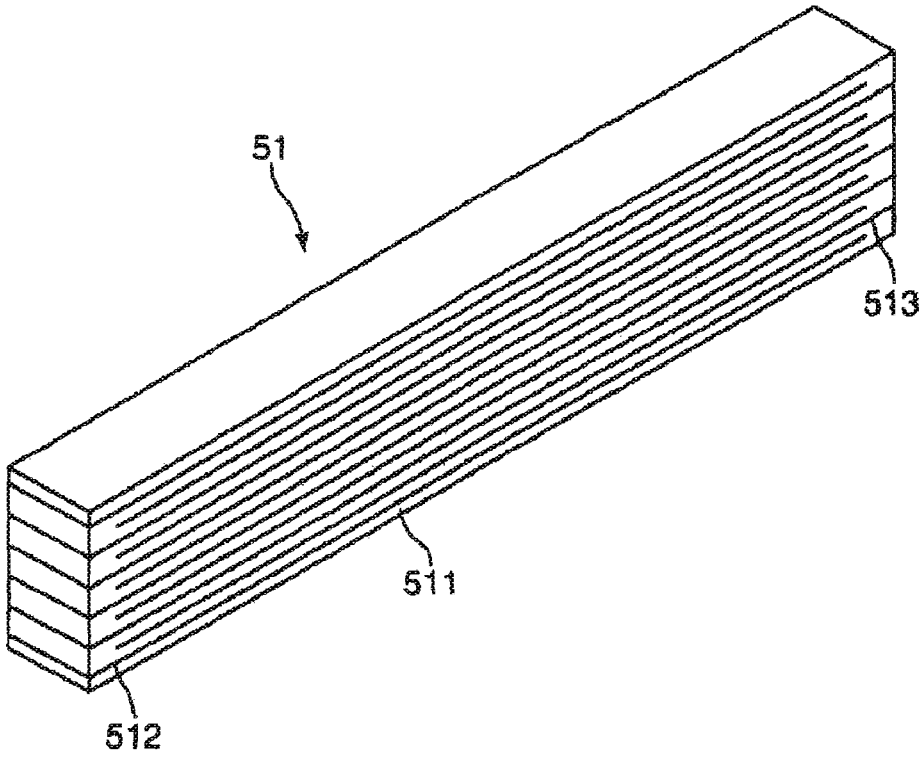
FIGS. 6A and 6B are perspective views showing the schematic structures of piezoelectric elements provided in the droplet discharging head shown in FIG. 3.
Figure 6B:
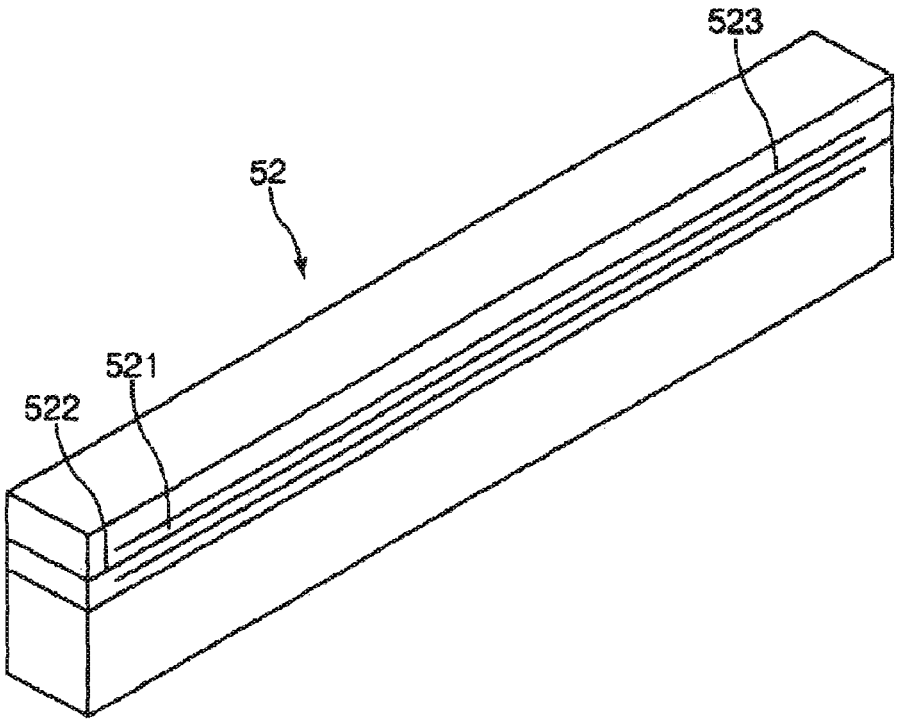

FIGS. 6A and 6B are perspective views showing the schematic structures of piezoelectric elements provided in the droplet discharging head shown in FIG. 3.

Figure 7A:
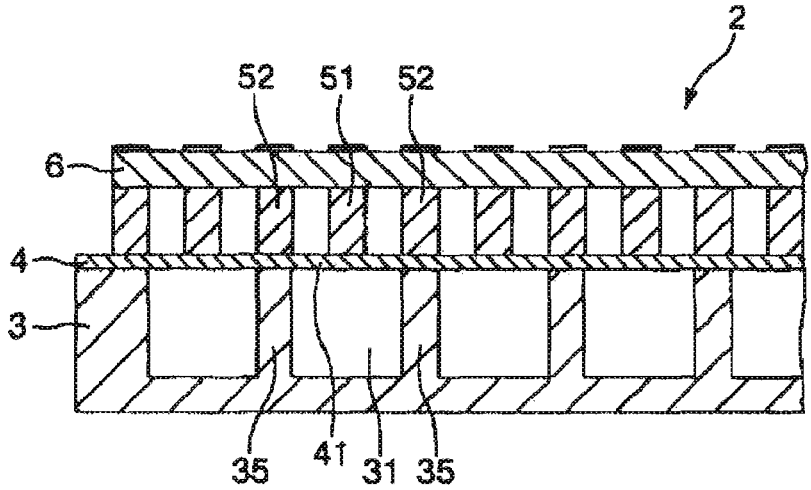
FIGS. 7A to 7C are views for explaining operations of the droplet discharging head shown in FIG. 3.
Figure 7B:
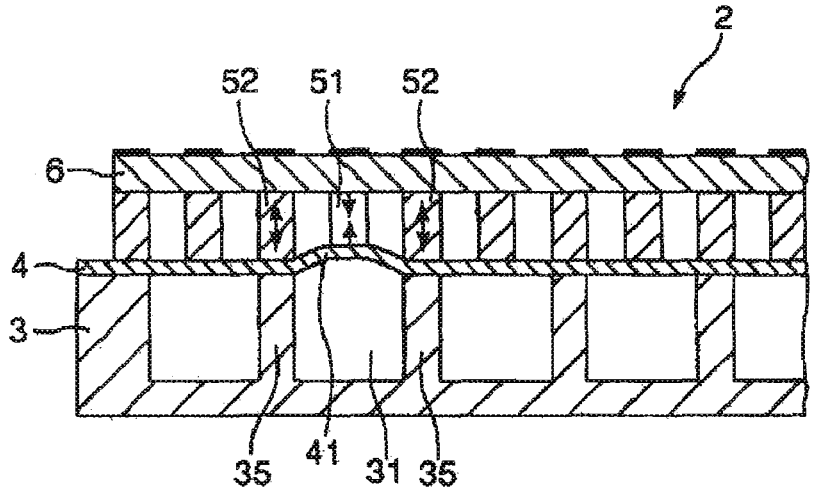
Figure 7C:
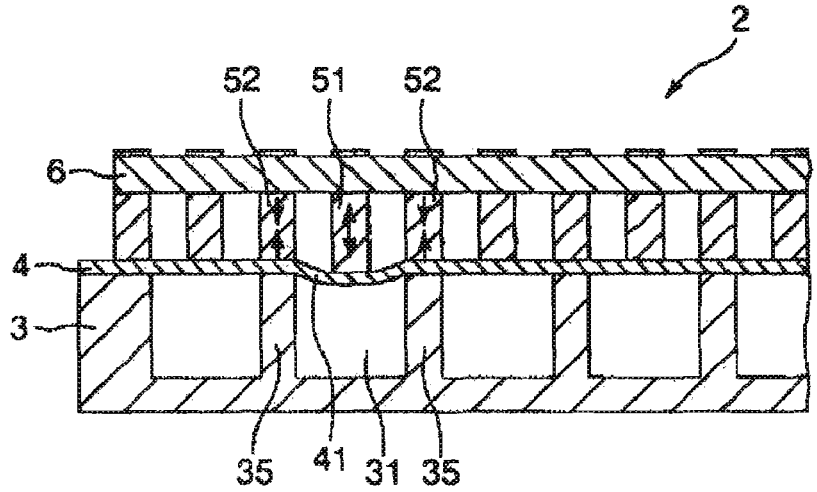

FIGS. 7A to 7C are views for explaining operations of the droplet discharging head shown in FIG. 3.

As shown in FIG. 3, the droplet discharging head 2 has two substrates 3 and 4 that are joined to each other, and a channel of a liquid material (the aforementioned liquid material 111) is formed between the substrates 3 and 4.

Main piezoelectric elements 51 and sub-piezoelectric elements 52 are mounted on the side remote from the foregoing channel of the substrate 4, and these elements are joined and fixed by a substrate 6.

Further specifically, as shown in FIG. 4, grooves and recesses are formed on the surface of the substrate 3 on the side of the substrate 4, partitioning and forming between the substrate 3 and the substrate 4 a plurality of containing chambers 31 (cavity) that contain a liquid material, the nozzle 32 that discharges a liquid material from each containing chamber 31, one common containing chamber 33 (reservoir) that contains a liquid material to be supplied to the containing chamber 31, and a supply path 34 for supplying a liquid material from the common containing chamber 33 to the containing chamber 31.

The plurality of containing chambers 31 are provided in parallel to on another with partition walls 35 interposed therebetween. Each containing chamber 31, which is partitioned and formed by the partition walls 35 and a member including a vibration plate 41, is communicated with the nozzle 32 and contains a liquid material.

Further specifically, each containing chamber 31 is formed substantially in a paper strip shape seen from the plane, and the plurality of containing chambers 31 are formed in parallel to one another in the shorter direction.

The containing chambers 31 that are adjacent to one another are partitioned from one another by the partition walls 35.

One end in the longitudinal direction of each containing chamber 31 is communicated with the nozzle 32.

The other end in the longitudinal direction of each containing chamber 31 is communicated with the common containing chamber 33 through the supply path 34.

Accordingly, a liquid material can be supplied from the common containing chamber 33 through the supply path 34 to the containing chamber 31.

The common containing chamber 33 is designed such that a liquid material is supplied through an unshown supply unit from the aforementioned tube 110.

A portion of the substrate 4 constituting part of the wall surface of each containing chamber 31 as described above functions as the vibration plate 41.

Therefore, by displacing (vibrating) each vibration plate 41, the volume of the corresponding containing chamber 31 is altered, allowing a droplet to be discharged from the nozzle 32.

In a portion corresponding to each containing chamber 31 on the surface on the side remote from the containing chamber 31 of the foregoing vibration plate 41, that is, on the surface on the side remote from the substrate 3 of the substrate 4, as shown in FIGS. 4 and 5, the main piezoelectric elements 51 are bonded along the longitudinal direction of the vibration plate 41.

In other words, each main piezoelectric element 51 is bonded onto the outer surface of the vibration plate 41 of each containing chamber 31.

Each piezoelectric element 51 is designed to expand and contract in the thickness direction of the vibration plate 41, as will be described later.

This causes the vibration plate 41 to be vibrated (displaced).

Each main piezoelectric element 51 as described above is provided with a first terminal 54 and a second terminal 55 coupled to the aforementioned head drive unit 208.

Therefore, by applying voltage to the main piezoelectric element 51 through the first terminal 54 and the second terminal 55, the main piezoelectric element 51 expands and contracts, allowing the vibration plate 41 to be displaced (vibrated).

In a portion corresponding to each partition wall 35 on the surface on the side remote from the substrate 3 of the substrate 4, the sub-piezoelectric element 52 is bonded along the longitudinal direction of each partition wall 35.

In other words, each sub-piezoelectric element 52 is bonded to a portion corresponding to each partition wall 35 on the side of the main piezoelectric element 51 of each containing chamber 31.

Each sub-piezoelectric element 52 is designed to expand and contract in the thickness direction of substrate 4, as will be described later.

The sub-piezoelectric element 52 is driven such that when one of the main piezoelectric element 51 and the sub-piezoelectric element 52 expands, the other contracts.

This allows not only a substrate 6, which will be described later, to be fixed to the substrate 4, but also the vibration of the vibration plate 41 by operations of expansion and contraction of the main piezoelectric element 51 to be optimized (suppression of crosstalk and increase in displacement amount of the vibration plate 41).

Each sub-piezoelectric element 52 as described above is provided with a first terminal 54 and a second terminal 55 coupled to the aforementioned head drive unit 208.

Therefore, by applying voltage to the sub-piezoelectric element 52 through the first terminal 54 and the second terminal 55, the sub-piezoelectric element 52 can be driven.

The substrate 6 is bonded and fixed onto the surfaces on the side remote from the substrate 4 of the main piezoelectric element 51 and the sub-piezoelectric element 52 as described above.

In other words, by the substrate 6, the main piezoelectric element 51 and the sub-piezoelectric element 52 that are adjacent to each other are linked to each other on the side remote from the containing chamber 31.

In the case where the main piezoelectric element 51 and the sub-piezoelectric element 52 that are adjacent to each other are linked to each other on the side remote from the containing chamber 31 in this manner, the driving power of the main piezoelectric element 51 can be more reliably and more efficiently transmitted to the vibration plate 41 to increase the amount of volume variation of the containing chamber 31.

As a result, electric power saving and cost reduction of the droplet discharging heads 2 can be achieved with more certainty.

On the substrate 6, access to the aforementioned first terminal 54 and the second terminal 55 from the outside is made possible.

The main piezoelectric element 51 and the sub-piezoelectric element 52 will be described in detail below.

As shown in FIG. 6A, the main piezoelectric element 51 has a plurality of piezoelectric material layers 511 having piezoelectricity, and pairs of electrode layers 512 and 513.

Each pair of the electrode layers 512 and 513 sandwich each piezoelectric material layer 511, and the piezoelectric material layer 511 and the electrode layers 512 and 513 are alternately layered in the thickness direction of the vibration plate 41.

That is, the main piezoelectric element 51 is a multilayered type piezoelectric element that expands and contracts in the vertical direction in FIG. 6A.

The main piezoelectric element 51, which is the foregoing multilayered type main piezoelectric element, allows increase of the displacement amount and, at the same time, reduction of the driving voltage.

The plurality of piezoelectric material layers 511 are formed such that the piezoelectric material layers 511 that are adjacent to each other have the polarization directions that are opposite to each other.

Specifically, odd-numbered piezoelectric material layers 511 from the side of the substrate 4 of the plurality of piezoelectric material layers 511 have the polarization directions that are opposite to those of the even-numbered piezoelectric material layers 511.

This allows with more certainty increase of the displacement amount of the main piezoelectric element 51 and, at the same time, reduction of the driving voltage.

Note that the term "polarization direction" as used herein means the following direction: under the condition where neither electric field nor stress is applied to a piezoelectric material layer, when positive electric charges and negative electric charges excessively exist in the vicinity of one surface and in the vicinity of the other surface of a piezoelectric material layer, respectively (spontaneous polarization or residual polarization), the direction from the surface of the piezoelectric material layer where negative charges are excessively exist to the surface where positive charges excessively exist.

The constituent material of the piezoelectric material layer 511, that is, a piezoelectric material is not particularly limited.

Examples of the material include zinc oxide, aluminum nitride, lithium tantalite, lithium niobate, potassium niobate, lead zirconate titanate (PZT), barium titanate and various other substances.

These may be used alone or in combination of two or more kinds.

In particular, materials mainly made of at least one kind of zinc oxide, aluminum nitride, lithium tantalite, lithium niobate, potassium niobate and PZT are preferable.

Note that the same is true for piezoelectric material layers 521 of the sub-piezoelectric element 52, which will be described later.

Each electrode layer 512 and each electrode layer 513 are interposed between the piezoelectric material layers 511. In order for the two adjacent electrode layers 512 and 513 to have an overlapping region (active region), one extends part way from one end in the longitudinal direction of the piezoelectric material layer 511 and the other extends part way from the other end of the piezoelectric material layer 511.

In other words, the electrode layer 512 that is odd-numbered from the side of the containing chamber 31 extends part way from one end in the longitudinal direction of the main piezoelectric element 51 that is in a longitudinal form (from the left side to the right side in FIG. 6A), whereas the electrode layer 513 that is even-numbered from the side of the containing chamber 31 extends part way from the other end in the foregoing longitudinal direction (from the right side to the left side in FIG. 6A) to have a region overlapping the electrode layer 512.

This makes it possible to drive the main piezoelectric element 51 by applying voltage to both ends in the longitudinal direction of the main piezoelectric element 51.

Here, the main piezoelectric element 51 is displaced by applying voltage to the piezoelectric material layer 511 in the foregoing overlapping region.

The first terminal 54 (see FIG. 3) is coupled to the electrode layer 512 at one end in the longitudinal direction of the main piezoelectric element 51.

The second terminal 55 (see FIG. 3) is coupled to the electrode layer 513 at the other end in the foregoing longitudinal direction.

This makes it possible to drive the main piezoelectric element 51 by applying voltage between the first terminal 54 and the second terminal 55.

The foregoing first terminal 54 and the second terminal 55 are each bent in L shape from an end face in the longitudinal direction of the main piezoelectric element 51 to the substrate 6 as shown in FIG. 3.

This allows the driving power of the main piezoelectric element 51 to be more reliably and more efficiently transmitted to the wall surface (vibration plate 41) to increase the amount of volume variation of the containing chamber 31, and, at the same time, voltage to be applied to the first terminal 54 and the second terminal 55 on the substrate 6.

As shown in FIG. 6B, the sub-piezoelectric element 52 has a plurality of piezoelectric material layers 521 having piezoelectricity, and pairs of electrode layers 522 and 523.

Each pair of the electrode layers 522 and 523 sandwich each piezoelectric material layer 521, and the piezoelectric material layer 521 and the electrode layers 522 and 523 are alternately layered in the thickness direction of the vibration plate 41 (substrate 4).

That is, the sub-piezoelectric element 52 is a multilayered type piezoelectric element.

The sub-piezoelectric element 52 is a multilayered type piezoelectric element that expands and contracts in the vertical direction in FIG. 6B.

The foregoing sub-piezoelectric element 52 allows increase of the displacement amount and, at the same time, reduction of the driving voltage.

The plurality of piezoelectric material layers 521 are formed such that the piezoelectric material layers 521 that are adjacent to each other have the polarization directions that are opposite to each other.

Specifically, odd-numbered piezoelectric material layers 521 from the side of the substrate 4 of the plurality of piezoelectric material layers 521 have the polarization directions that are opposite to those of the even-numbered piezoelectric material layers 521.

This allows with more certainty increase of the displacement amount of the sub-piezoelectric element 52 and, at the same time, reduction of the driving voltage.

In particular, the polarization directions of the odd-numbered piezoelectric material layers 521 of the sub-piezoelectric element 52 are opposite to those of the odd-numbered piezoelectric material layers 511 of the above-described main piezoelectric element 51.

Accordingly, the polarization directions of the even-numbered piezoelectric material layers 521 of the sub-piezoelectric element 52 are opposite to those of the even-numbered piezoelectric material layers 511 of the above-described main piezoelectric element 51.

Thus, if the first terminal 54 coupled to the main piezoelectric element 61 and the first terminal 54 coupled to the sub-piezoelectric element 52 serve as a common electrode and the second terminal 55 coupled to the main piezoelectric element 51 and the second terminal 55 coupled to the sub-piezoelectric element 52 serve as a common electrode, one of the main piezoelectric element 51 and the sub-piezoelectric element 52 can contract when the other expands.

The formation methods of the above-described main piezoelectric element 51 and the sub-piezoelectric element 52 are each not particularly limited, and include, for example, a method of alternately depositing and layering a piezoelectric material and an electrode material on the substrate 4, forming the first terminal 54 and the second terminal 55 on the layered material, and thereafter applying an electric field having a certain value or more between the first terminal 54 and the second terminal 55 (i.e., polarizing process).

In this case, by making the polarization process for the sub-piezoelectric element 52 to be in the direction opposite to that of the polarization process for the main piezoelectric element 51 (specifically, reversing polarities of the first terminal 54 and the second terminal 55), the main piezoelectric element 51 and the sub-piezoelectric element 52 having the polarization directions as described above can be obtained.

Each electrode layer 522 and each electrode layer 523 are interposed between the piezoelectric material layers 521.

In order for the two adjacent electrode layers 522 and 523 to have an overlapping region (active region), one extends part way from one end in the longitudinal direction of the piezoelectric material layer 521 and the other extends part way from the other end of the piezoelectric material layer 521.

In other words, the electrode layer 522 that is odd-numbered from the side of the containing chamber 31 extends part way from one end in the longitudinal direction of the sub-piezoelectric element 52 that is in a longitudinal form (from the left side to the right side in FIG. 6B), whereas the electrode layer 523 that is even-numbered from the side of the containing chamber 31 extends part way from the other end in the foregoing longitudinal direction (from the right side to the left side in FIG. 6B) to have a region overlapping the electrode layer 522.

This makes it possible to drive the sub-piezoelectric element 52 by applying voltage to both ends in the longitudinal direction of the sub-piezoelectric element 52.

Here, the sub-piezoelectric element 52 is displaced by applying voltage to the piezoelectric material layer 521 in the foregoing overlapping region.

Note that, in the embodiment, the area of the overlapping region between the electrode layers 522 in the sub-piezoelectric element 52 is substantially equal to that of the overlapping region between the electrode layers 512 in the main piezoelectric element 51.

In the embodiment, particularly, the number of the piezoelectric material layers 521 is smaller than that of the piezoelectric material layers 511 of the aforementioned main piezoelectric element 51.

Thus, if the same voltage is applied to the main piezoelectric element 51 and the sub-piezoelectric element 52, the displacement amount of the sub-piezoelectric element 52 can be smaller than that of the main piezoelectric element 51.

As a result, if the same voltage is used to drive the main piezoelectric element 51 and the sub-piezoelectric element 52, crosstalk is suppressed and, at the same time, unintended vibrations are suppressed with certainty, enabling stable discharges to be achieved with more certainty.

In particular, unintended deflection and deformation in the longitudinal direction of the containing chambers 31 are prevented, enabling stable discharges to be achieved.

The first terminal 54 (see FIG. 3) is coupled to the electrode layer 522 at one end in the longitudinal direction of the sub-piezoelectric element 52.

The second terminal 55 (see FIG. 3) is coupled to the electrode layer 523 at the other end in the foregoing longitudinal direction.

This makes it possible to drive the sub-piezoelectric element 52 by applying voltage between the first terminal 54 and the second terminal 55.

The first terminal 54 and the second terminal 55 are each bent in L shape from an end face in the longitudinal direction of the sub-piezoelectric element 52 to the substrate 6 as shown in FIG. 3.

This makes it possible to drive the sub-piezoelectric element 52 by applying voltage to the first terminal 54 and the second terminal 55 on the substrate 6.

Here, operations of the main piezoelectric element 51 and the sub-piezoelectric element 52, that is, operations of the droplet discharging device 1 will be described.

The main piezoelectric element 51 and two sub-piezoelectric elements 52 positioned on the both ends thereof are made as a set, and a voltage having the same waveform is applied to these elements.

That is, a voltage having the same waveform is applied with the first terminal 54 coupled to the main piezoelectric element 51 and the first terminals 54 coupled to one pair of the sub-piezoelectric elements 52 adjacent to the main piezoelectric element 51 serving as a common electrode, and with the second terminal 55 coupled to the main piezoelectric element 51 and the second terminals 55 coupled to the one pair of the sub-piezoelectric elements 52 serving as a common electrode.

Accordingly, when the main piezoelectric element 51 expands, the sub-piezoelectric element 52 contracts in synchronization with the expansion, whereas when the main piezoelectric element 51 contracts, the sub-piezoelectric element 52 expands in synchronization with the contraction.

That is, when one of the main piezoelectric element 51 and the sub-piezoelectric element 52 expands, the other contracts.

Particularly, in the embodiment, the number of the piezoelectric material layers of the sub-piezoelectric element 52 is smaller than that of the piezoelectric material layers of the main piezoelectric element 51.

Therefore, if a voltage having the same waveform (same voltage) is used, the displacement amount (width of expansion and contraction) of the sub-piezoelectric element 52 is smaller than that of the main piezoelectric element 51.

Thus, if the same voltage is used to drive the main piezoelectric element 51 and the sub-piezoelectric element 52, it is possible to prevent the sub-piezoelectric element 52 from being displaced more than required, driving the droplet discharging head 2 more stably.

More specifically, crosstalk can be prevented from occurring with more certainty, and the drive force of the main piezoelectric element 51 can be effectively transmitted to the vibration plate 41.

The droplet discharging device 1 as described above has low-cost and stable discharge performance.

In particular, the head drive unit 208 (driving device) that drives the main piezoelectric element 51 and the sub-piezoelectric element 52 makes a voltage and its waveform to be applied to the main piezoelectric element 51 equal to those to be applied to the sub-piezoelectric element 52, and applies these voltages simultaneously.

This allows stable discharges to be achieved and, at the same time, the cost of the droplet discharging device 1 to be reduced with more certainty.

Second Embodiment

Next, a second embodiment of the droplet discharging head and the droplet discharging device of the invention will be described.

Figure 8A:
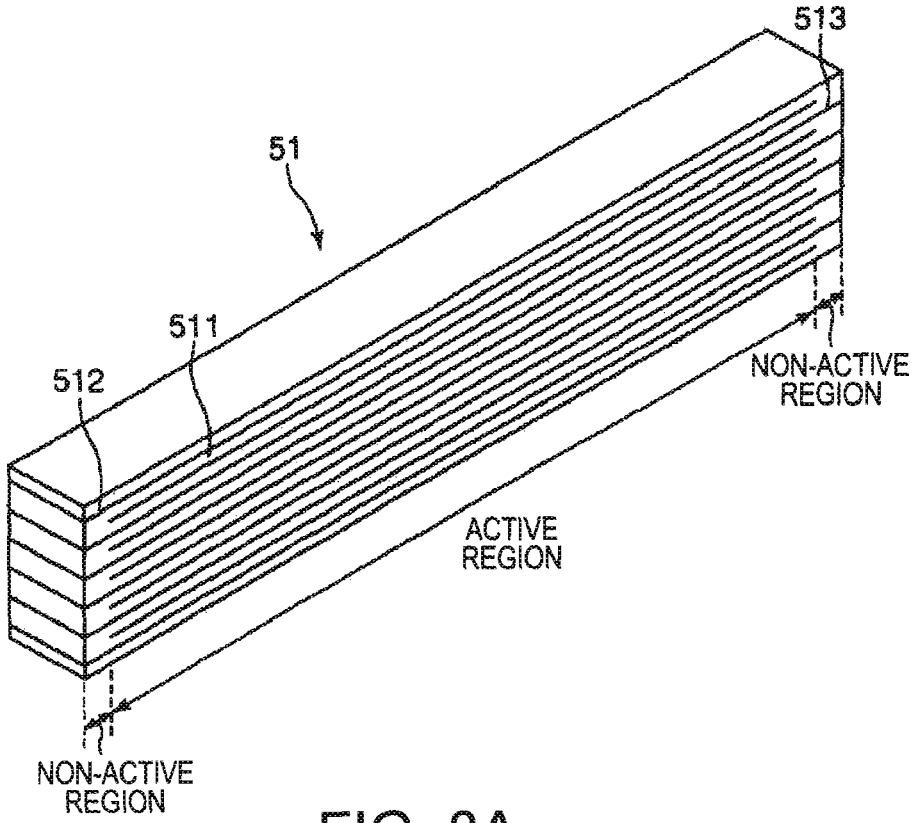
FIGS. 8A and 8B are perspective views showing the schematic structures of piezoelectric elements provided in the droplet discharging head according to a second embodiment of the invention.
Figure 8B:
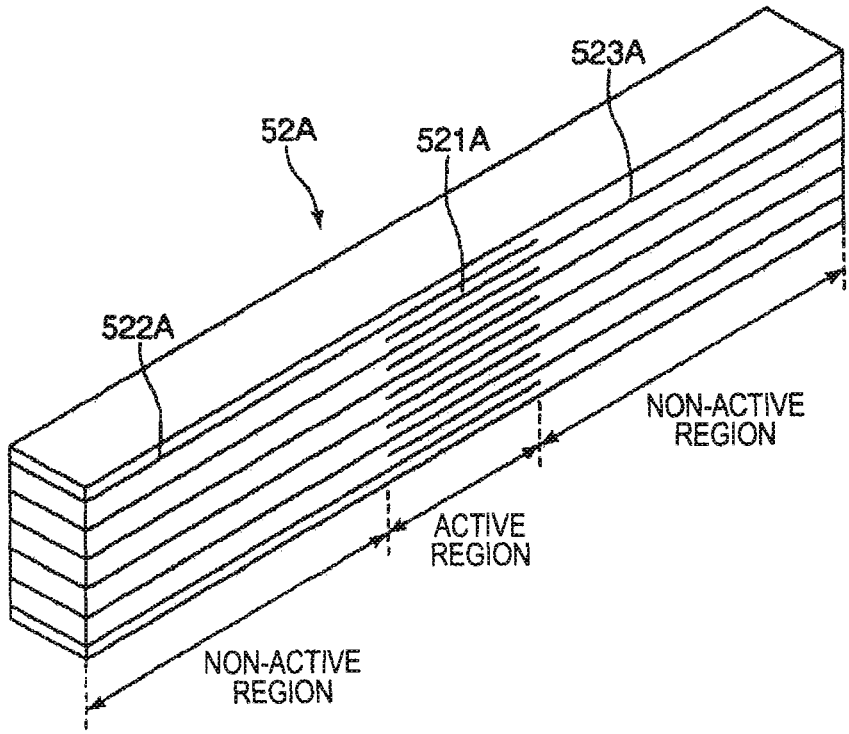

FIGS. 8A and 8B are perspective views showing the schematic structures of a main piezoelectric element and a sub-piezoelectric element according to the second embodiment of the invention.

A droplet discharging head and a droplet discharging device according to the present embodiment are the same as those according to the above-described first embodiment except that the structure of the sub-piezoelectric element is different.

Note that, in the description that follows, explanations will be made with attention focused on differences of the droplet discharging head and the droplet discharging device in the second embodiment from those in the first embodiment, and explanations will be omitted for the same points as found in the first embodiment.

In the embodiment, as shown in FIGS. 8A and 8B, the area of an overlapping region (active region shown in FIG. 8B) between adjacent electrode layers 522A and 523A in a sub-piezoelectric element 52A is smaller than that of an overlapping region (active region shown in FIG. 8A) between adjacent electrode layers 512 and 513 in the main piezoelectric element 51.

Here, in regions other than the active region (non-active regions shown in FIG. 8B), because voltage is not applied to piezoelectric material layers 521A, displacement does not occur.

As a result, if the same voltage is applied to the main piezoelectric element 51 and the sub-piezoelectric element 52A, the displacement amount of the sub-piezoelectric element 52A can be smaller than that of the main piezoelectric element 51.

With the foregoing structure, the main piezoelectric element 51 and the sub-piezoelectric element 52A are driven using the same voltage, making it possible to achieve stable discharges with more certainty.

While the droplet discharging head and the droplet discharging device of the invention have been described based on the embodiments with reference to the accompanying drawings, it is to be understood that the invention is not limited to these embodiments.

In the droplet discharging head and the droplet discharging device of the invention, regarding the structure of each part, any structure fulfilling the same function as in the embodiments may be used instead of or in addition to the structure in the embodiments.

The droplet discharging head and the droplet discharging device of the invention, for example, may be a combination of any structures of the first and second embodiments.

While a main piezoelectric element and a sub-piezoelectric element are layered-type piezoelectric elements in the above-described embodiments, the main piezoelectric element and the sub-piezoelectric element may be piezoelectric elements with a single piezoelectric material layer.

Specifically, each of the main piezoelectric element and the sub-piezoelectric element only has to have a piezoelectric material layer that is at least one layered and has piezoelectricity, and at least one pair of electrode layers that sandwich the piezoelectric material layer in such a manner that the piezoelectric material layer and the electrode layers are alternately layered in the thickness direction of the vibration plate 41.

If the main piezoelectric element and the sub-piezoelectric element are piezoelectric elements having a single-layered piezoelectric material layer, the substrate 4 may be a common electrode and another common electrode may also be provided between the substrate 4 and the main piezoelectric element or the sub-piezoelectric element.

The entire disclosure of Japanese Patent Application No: 2006-084083, filed Mar. 24, 2006 is expressly incorporated by reference herein.

What is claimed is:

1. A droplet discharging head, comprising:

a vibration plate;

a partition wall attached to a first surface of the vibration plate, the partition wall defining a plurality of containing chambers, each of the plurality of containing chambers being configured to hold a liquid material and to eject the liquid material from a nozzle;

a first piezoelectric element attached to a second surface of the vibration plate, the first piezoelectric element overlapping with one of the plurality of containing chambers, the first piezoelectric element including a plurality of first piezoelectric material layers and a plurality of first electrode layers, the plurality of first piezoelectric material layers and the plurality of a first electrode layers being laminated alternately; and a second piezoelectric element attached to the second surface of the vibration plate, the second piezoelectric element being adjacent to the first piezoelectric element, the second piezoelectric element overlapping with a first portion of the partition wall, a first part of the vibration plate being interposed between the second piezoelectric element and the first portion of the partition wall, the second piezoelectric element including a plurality of second piezoelectric material layers and a plurality of second electrode layers, the plurality of second piezoelectric material layers and the plurality of a second electrode layers being laminated alternately, a polarization direction of odd-numbered one of the plurality of first piezoelectric material layers being opposite to a polarization direction of odd-numbered one of the plurality of second piezoelectric material layers.

2. The droplet discharging head according to claim 1, a polarization direction of odd-numbered one of the plurality of first piezoelectric material layers being opposite to a polarization direction of even-numbered one of the plurality of first piezoelectric material layers.

3. The droplet discharging head according to claim 1, a displacement amount of the first piezoelectric element at a first voltage being configured to be larger than a displacement amount of the second piezoelectric element at a second voltage, the first voltage being equal to the second voltage.

4. The droplet discharging head according to claim 1, a number of the plurality of second piezoelectric material layers in the second piezoelectric element being smaller than a number of the plurality of first piezoelectric material layers in the first piezoelectric element.

5. The droplet discharging head according to claim 1, an area of an overlapping region of mutually adjacent ones of the plurality of a second electrode layers in the second piezoelectric element being smaller than an area of an overlapping region of mutually adjacent ones of the plurality of a first electrode layers in the first piezoelectric element.

6. The droplet discharging head according to claim 1, further comprising:

a substrate, the first piezoelectric element being interposed between the substrate and the vibration plate, and the second piezoelectric element being interposed between the substrate and the vibration plate.

7. The droplet discharging head according to claim 1, further comprising:

a third piezoelectric element attached to the second surface of the vibration plate, the third piezoelectric element being adjacent to the first piezoelectric element, the first piezoelectric element being disposed between the second and third piezoelectric element, the third piezoelectric element overlapping with a second portion of the partition wall, a second part of the vibration plate being interposed between the third piezoelectric element and the second portion of the partition wall, the third piezoelectric element including a plurality of third piezoelectric material layers and a plurality of third electrode layers, the plurality of third piezoelectric material layers and the plurality of third electrode layers being laminated alternately, a polarization direction of odd-numbered one of the plurality of first piezoelectric material layers being opposite to a polarization direction of odd-numbered one of the plurality of third piezoelectric material layers.

8. A droplet discharging device comprising the droplet discharging head according to claim 1.

9. A droplet discharging device, comprising:

the droplet discharging head according to claim 1; and a drive unit for driving each of the first piezoelectric element and the second piezoelectric element, the drive unit being coupled to each of the first piezoelectric element and the second piezoelectric element so as to simultaneously apply an voltage with an identical waveform to each of the first piezoelectric element and the second piezoelectric element.

* * * * *